US005579746A

United States Patent [19]

Hamburg et al.

[11] Patent Number: 5,579,746

[45] Date of Patent: Dec. 3, 1996

[54] ENGINE LEAN AIR/FUEL CONTROL SYSTEM

[76] Inventors: Douglas R. Hamburg, 6899 Sandalwood Dr., Bloomfield, Mich. 48301; Dennis C. Reed, 41795 Elk, Plymouth, Mich. 48170; Nicholas G. Zorka, 8117 Sleepy Time Ct., Clarkston, Mich. 48348

[21] Appl. No.: 485,064

[22] Filed: Jun. 8, 1995

[51] Int. Cl.[6] ..... F02D 41/14

[52] U.S. Cl. ..... 123/689; 123/695

[58] Field of Search ..... 123/679, 686, 123/689, 695

[56] References Cited

U.S. PATENT DOCUMENTS

| | | | |
|---|---|---|---|
| 4,109,615 | 8/1978 | Asano | 123/695 |
| 4,120,269 | 10/1978 | Fujishiro | 123/695 |
| 4,132,200 | 1/1979 | Asano et al. | 123/694 |
| 4,170,965 | 10/1979 | Aono | 123/695 |
| 4,187,806 | 2/1980 | Schnurle et al. | 123/695 |
| 4,364,227 | 12/1982 | Yoshida et al. | 123/695 |
| 4,458,319 | 7/1984 | Chujo et al. | 123/695 |
| 4,459,669 | 7/1984 | Chujo et al. | 123/695 |
| 5,211,011 | 5/1993 | Nishikawa et al. | 60/284 |
| 5,396,875 | 3/1995 | Kotwicki et al. | 123/695 |
| 5,440,877 | 8/1995 | Kamura et al. | 123/695 |

*Primary Examiner*—Willis R. Wolfe

[57] ABSTRACT

An air/fuel control system for an engine (28) provides an air/fuel indicating signal linearly related to average engine air/fuel operation from a two-state exhaust gas oxygen sensor (44). Fuel delivered to the engine is modulated with a periodic signal (144). A reference value corresponding to a desired air/fuel ratio is subtracted from a rolling average of the exhaust gas oxygen sensor output to provide an error signal (148–152). A feedback variable (FV) for adjusting the engine air/fuel ratio is generated from a proportional plus integral controller having the error signal as its input (156). In this manner, average engine air/fuel ratio is maintained at the desired air/fuel ratio and the rolling average of the exhaust gas oxygen sensor output provides an air/fuel indicating signal.

9 Claims, 6 Drawing Sheets

ENGINE LEAN AIR/FUEL CONTROL SYSTEM

BACKGROUND OF THE INVENTION

The field of the invention relates to engine control systems, including air/fuel and ignition control systems.

It is known no retard ignition timing to more rapidly heat engine exhaust gases and the catalytic converter coupled to the exhaust gases. Such a system is shown in U.S. Pat. No. 5,211,011 which also describes alternately running fuel delivered to the engine rich and then lean while the converter is below a desired temperature.

The inventors herein have recognized numerous problems with the above approaches. For example, an open loop lean fuel command which is intended to result in air/fuel operation slightly lean of stoichiometry may result in air/fuel operation leaner than desired causing rough engine operation and increased emissions. Such leaner than desired operation may occur as the engine and its components age (e.g., slightly clogged fuel injectors). Another problem is that lean operation may reduce engine power which is annoying to the vehicular operator when power is demanded.

SUMMARY OF THE INVENTION

An object of the invention claimed herein is to provide an air/fuel control system responsive to a two-state exhaust gas oxygen sensor which is capable of running the engine at any desired air/fuel ratio.

The problems of prior approaches are overcome, and the objects and advantages of the claimed invention achieved, by providing a control method for an engine having an exhaust gas oxygen sensor with a two-state output having first and second states respectively corresponding to exhaust gases being rich or lean of stoichiometry. In one particular aspect of the invention, the method comprises the steps of:

delivering fuel to the engine;

modulating the delivered fuel;

averaging the exhaust gas oxygen sensor output to provide an air/fuel indicating signal having an amplitude related to engine air/fuel operation; selecting both a desired air/fuel ratio and a reference value corresponding to the desired air/fuel ratio; generating an error signal from a difference between the averaged sensor output and the reference value; integrating the error signal to generate a feedback variable; and correcting the delivered fuel with the feedback variable so that engine air/fuel operation averages at the desired air/fuel ratio.

An advantage of the above aspect of the invention is that the engine air/fuel ratio may be operated at any desired air/fuel ratio within a preset range. Another advantage of the above aspect of the invention is that the engine air/fuel ratio may run on average at a preselected lean value using feedback control, thereby avoiding the disadvantages of prior approaches wherein an open loop lean value was selected which may have been too lean for smooth engine operation.

In another aspect of the invention, the control system comprises: an exhaust gas oxygen sensor with a two state output having first and second states respectively corresponding to exhaust gases being rich or lean of stoichiometry; a fuel controller delivering fuel to the engine in response to a desired fuel signal; a controller modulating the desired fuel signal and averaging an output of the exhaust gas oxygen sensor to provide an air/fuel indicating signal having an amplitude related to engine air/fuel operation; reference means for providing a reference signal having a first reference value corresponding to an air/fuel ratio lean of stoichiometry during cold engine operation and a second reference value corresponding to a stoichiometric air/fuel ratio during warm engine operation; and feedback means for integrating an error signal derived from a difference between the air/fuel indicating signal and said reference signal to generate a feedback variable, and correcting the delivered fuel with the feedback variable so that engine air/fuel operation averages at the desired air/fuel ratio.

An advantage of the above aspect of the invention is that accurate lean air/fuel operation is provided using feedback control during cold engine operation to more rapidly heat the catalytic converter without incurring rough operation.

BRIEF DESCRIPTION OF THE DRAWINGS

The object and advantages of the claimed invention will become more readily apparent from the following detailed example of operation described with reference to the drawings wherein:

DESCRIPTION OF AN EXAMPLE OF OPERATION

Figure 1:
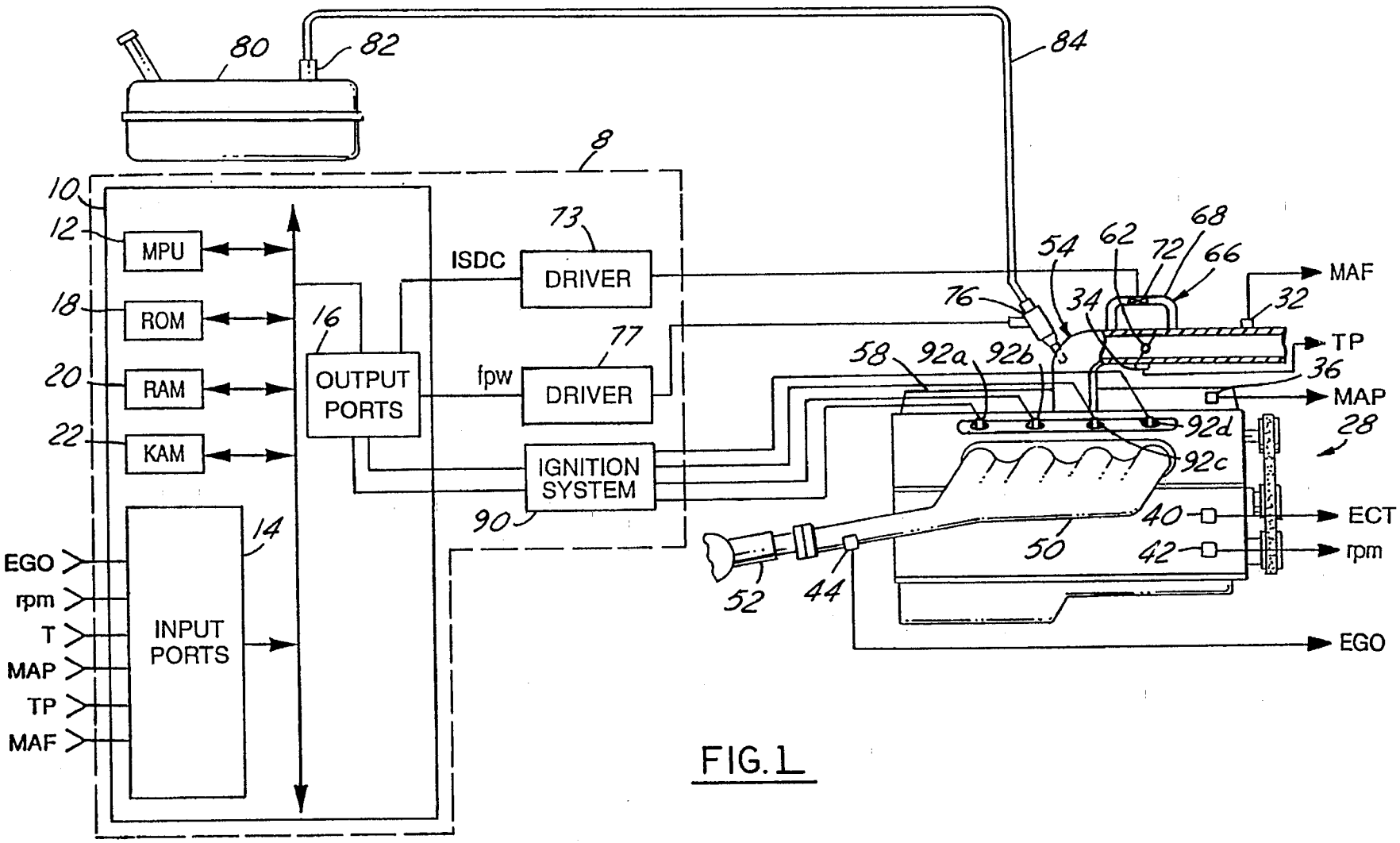
FIG. 1 is a block diagram of an embodiment in which the invention is used to advantage.

Controller 8 is shown in the block diagram of FIG. 1 including conventional microcomputer 10 having: microprocessor unit 12; input ports 14; output ports 16; read only memory 18, for storing control programs; random access memory 20, for temporary data storage which may also be used for counters or timers; keep-alive memory 22, for storing learned values; and a conventional data bus. As described in greater detail later herein, controller 8 controls operation of engine 28 by the following control signals; pulse width signal fpw for controlling liquid fuel delivery via drivers 77; idle speed duty cycle signal ISDC for controlling engine idle speed via drivers 73; and conventional distributorless ignition system 90 for providing ignition current to spark plugs 92*a–d*.

Controller 8 is shown receiving various signals from conventional engine sensors coupled to engine 28 including: measurement of inducted mass airflow (MAF) from mass airflow sensor 32; indication of primary throttle position (TP) from throttle position sensor 34; manifold absolute pressure (MAP), commonly used as an indication of engine load, from pressure sensor 36; engine coolant temperature (ECT) from temperature sensor 40; indication of engine speed (rpm) from tachometer 42; and output signal EGO from exhaust gas oxygen sensor 44 which, in this particular example, provides an indication of whether exhaust gases are either rich or lean of stoichiometric combustion.

In this particular example, engine 28 is shown having EGO sensor 44 coupled to exhaust manifold 50 upstream of conventional catalytic converter 52. Intake manifold 58 of engine 28 is shown coupled to throttle body 54 having primary throttle plate 62 positioned therein. Bypass throttling device 66 is shown coupled to throttle body 54 and includes; bypass conduit 68 connected for bypassing primary throttle plate 62; and solenoid valve 72 for throttling conduit 68 in proportion to the duty cycle of idle speed duty cycle signal ISDC from controller 8. Throttle body 54 is also shown having fuel injector 76 coupled thereto for delivering liquid fuel in proportion to the pulse width of signal fpw from controller 8. Fuel is delivered to fuel injector 76 by a conventional fuel system including fuel tank 80, fuel pump 82, and fuel rail 84.

Figure 2A:
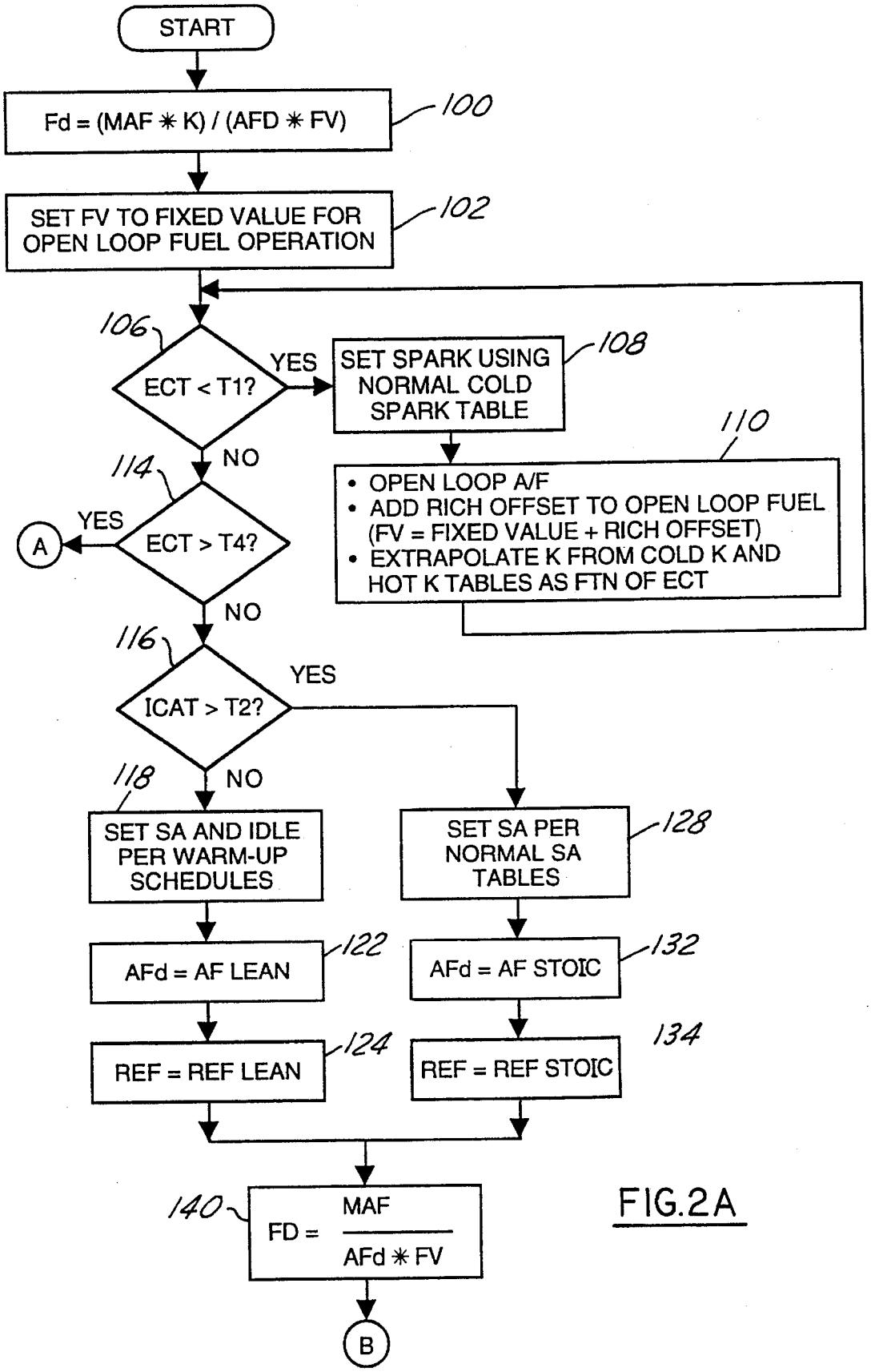
FIGS. 2A–2B are flow charts of various operations performed by portions of the embodiment shown in FIG. 1.
Figure 2B:
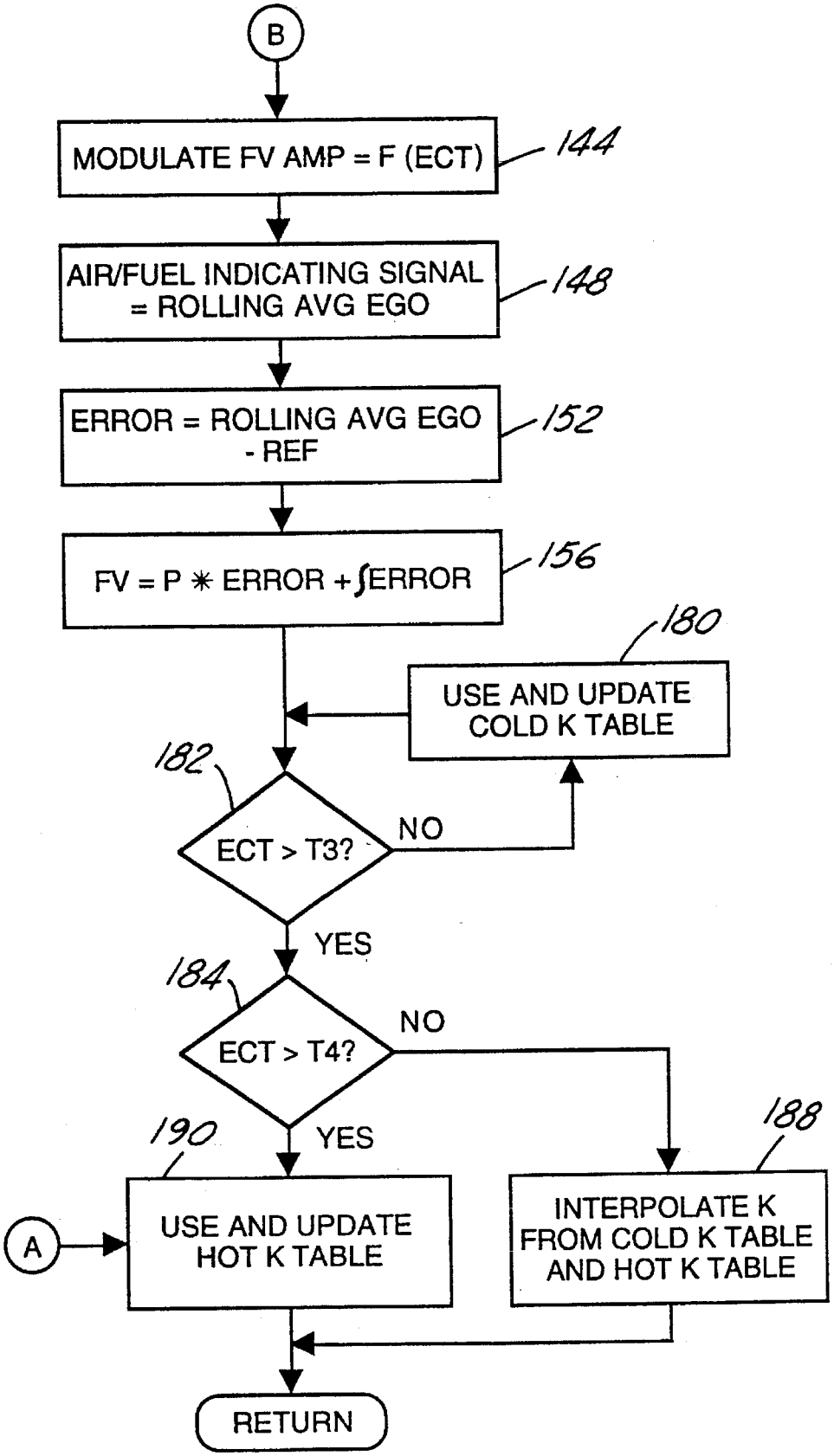

A description of various air/fuel operations performed by controller 8 is now commenced with initial reference to the flow charts shown in FIGS. 2A–2B. During step 100, the fuel command (shown as desired fuel quantity Fd) is calculated by dividing the product of desired air/fuel ratio AFD times feedback variable FV into the product of inducted mass flow measurement MAF times correction value K. In this particular example, desired air/fuel ratio AFD is the stoichiometric value of the fuel blend used which is 14.3 pounds of air per pound of fuel for a low emissions fuel blend. Feedback variable FV and correction value K are each generated by the feedback routines, responsive to EGO sensor 44, which are described later herein with particular reference to respective FIGS. 3 and 4.

Continuing with FIGS. 2A–2B, feedback variable FV is initially set to a fixed value for open loop air/fuel operation (step 102). Stated another way, desired fuel quantity Fd provides an open loop fuel command which is related to signal MAF and is not adjusted by feedback. In this particular example, feedback variable FV is set to unity which would correspond to operation at desired air/fuel ratio AFD under ideal operating conditions without any engine component aging. It is well known, however, that this open loop operation may not result in engine air/fuel exactly at stoichiometry. Correction by correction value K, however, will be provided as described below.

When engine coolant temperature ECT is less than predetermined temperature T1 (step 106), engine temperature is too low to enter the subroutine for converter warm-up. The subroutine described with reference to steps 108–110 is then entered to minimize the time required to start and reliably warm-up engine 28. In step 108, ignition timing is first set using the cold start table stored in microcomputer 10. Various sub steps are then performed during step 110. Open loop air/fuel operation proceeds by adding a rich offset to desired fuel quantity Fd. In this particular example, feedback variable FV is set to a fixed value less than unity. Correction value K is then extrapolated from two tables stored in microcomputer 10 which store correction K for cold engine operation and hot engine operation, respectively. In this example, the extrapolation occurs as a function of engine coolant temperature ECT.

In the event engine coolant temperature ECT is greater than temperature T1 (step 106), it is compared to temperature T4 (step 114) which is associated with hot engine operation and normal air/fuel ratio control. If engine coolant temperature ECT is less than temperature T4, an inference of the temperature of catalytic converter 52 (ICAT) is compared to temperature T2 (step 116).

When inferred temperature ICAT is less than temperature T2, ignition timing and engine idle speed are set per the warm-up schedules (step 118) provided for rapid catalyst warm-up. That is, ignition timing is retarded from its nominal value and idle speed elevated. Desired engine air/fuel ratio AFd is set to a lean value (AFLEAN) which is lean of stoichiometry by a preselected amount as shown in step 122. In this particular example, stoichiometry is 14.3 pounds of air per pound of fuel and AFLEAN is 14.6 pounds of air per pound of fuel. During step 124, reference signal REF is set equal to lean value REFLEAN which corresponds to desired lean air/fuel ratio AFLEAN.

On the other hand, if inferred temperature ICAT is greater than temperature T2, normal ignition timing and idle speed tables are utilized (step 128). Desired air/fuel ratio AFd is then set equal to the air/fuel ratio corresponding to stoichiometry (AFSTOIC) as shown in step 132. During step 134, reference signal REF is set equal to a value corresponding to the stoichiometric air/fuel ratio (REFSTOIC).

Desired fuel quantity Fd is generated during step 140 which corresponds to the amount of liquid fuel to be delivered to engine 28. More specifically, desired fuel quantity signal Fd is generated by dividing the product of desired air/fuel ratio AFd and feedback variable FV into measurement of inducted mass air flow MAF times a correction value (not shown). Feedback variable FV is modulated during step 144 by a periodic signal. In this particular example, the periodic signal is selected as a triangular wave (see FIG. 3E). The peak to peak amplitude of the periodic signal is established as a function of engine coolant temperature ECT to provide a relatively constant exhaust air/fuel amplitude as engine 28 warms.

A rolling average of signal EGO is generated during step 148. Error signal ERROR is generated during step 152 by subtracting reference signal REF from the rolling average of signal EGO (152). The feedback variable FV is then generated by applying a proportional plus integral (PI) controller to signal ERROR as shown in step 156. More specifically, signal ERROR is multiplied by proportional gain value P and the product added to the integral of signal ERROR.

The operation and advantageous effects of steps 122–156 will be better understood by reviewing an example of operation with particular reference to the waveforms shown in FIGS. 3A–3E. Before discussing FIGS. 3A–3E, the description of updating the cold K and hot K tables is completed with continuing reference to FIG. 2B.

When engine coolant temperature ECT is greater than temperature T3 (step 182), but less than temperature T4 (step 184), each correction value K is interpolated from the cold K and hot K tables stored in microcomputer 10 for each engine speed load range (step 188). In the event engine coolant temperature ECT is greater than temperature T4 (step 184), each correction value K is selected from the hot K tables of microcomputer 10 (step 190).

Figure 5:
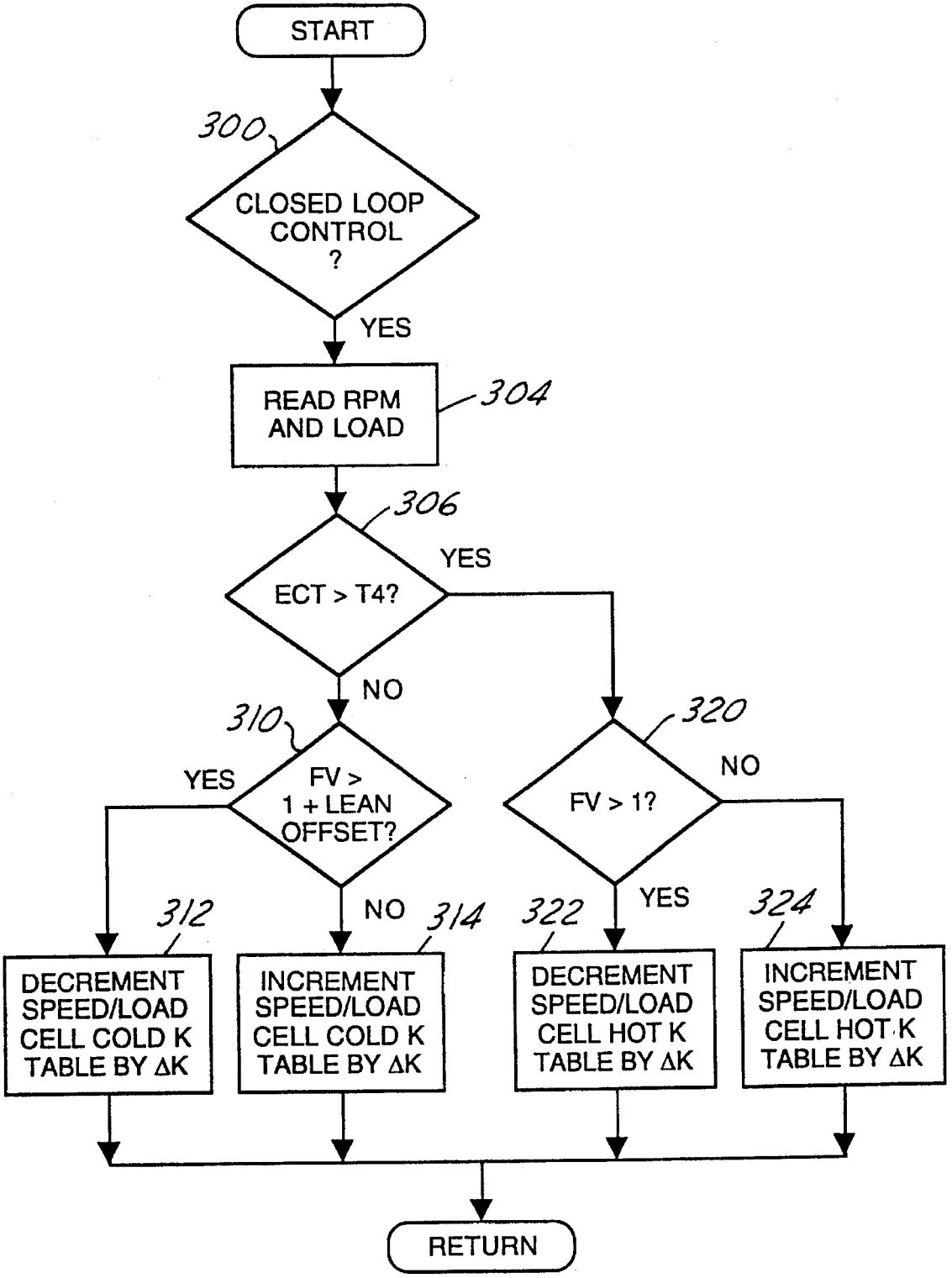
FIG. 5 is a flow chart of various operations performed by portions of the embodiment shown in FIG. 1.

It is noted that correction values K for the hot K table are generated by adaptive learning as described later herein with particular reference to FIG. 5. By generating two sets of correction values (K) for cold and hot engine operation, and either extrapolating (step 110) or interpolating (step 188) between the tables, more accurate air/fuel operation is obtained. Once again, engine air/fuel operation is provided at either stoichiometry or preselected air/fuel ratios lean of stoichiometry by a preselected amount far more accurately than heretofore possible.

Figure 3A:
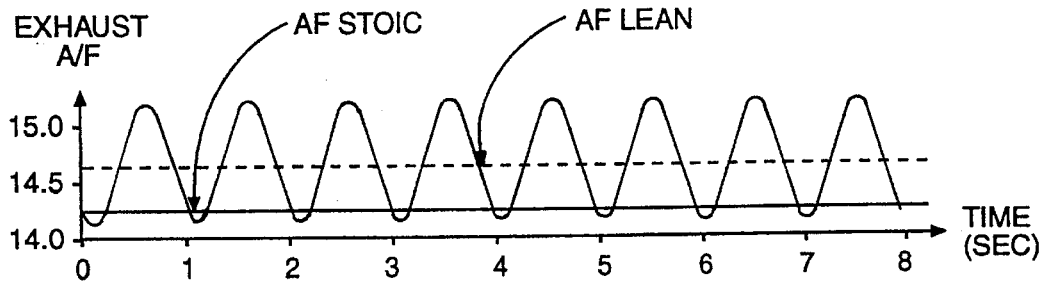
FIGS. 3A–3E illustrate various electrical waveforms corresponding to various operations performed by the embodiment shown in FIG. 1 with particular reference to the operation described with particular reference to FIGS. 2A–2B.
Figure 3B:
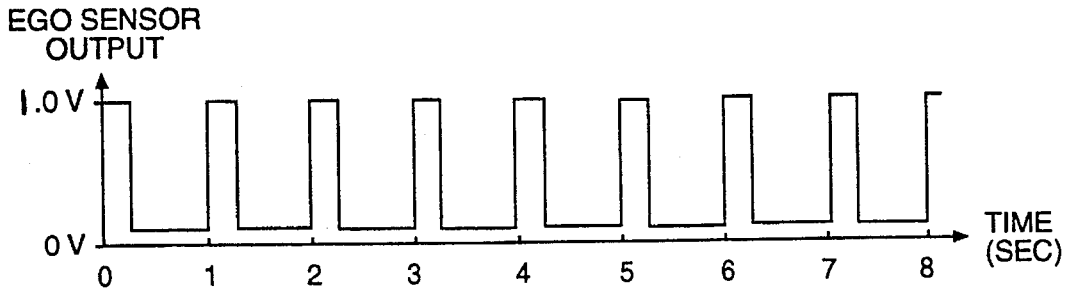
Figure 3C:
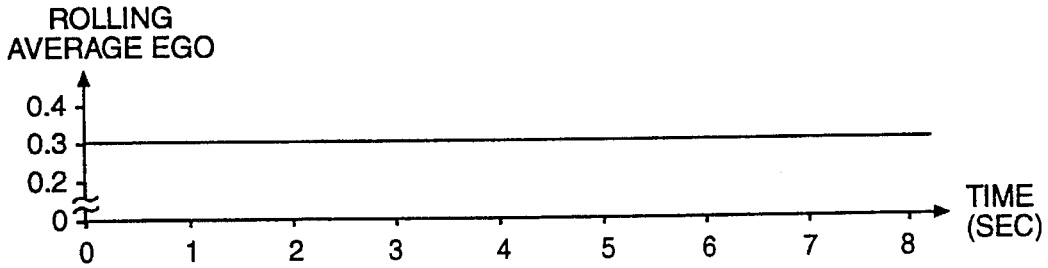
Figure 3D:
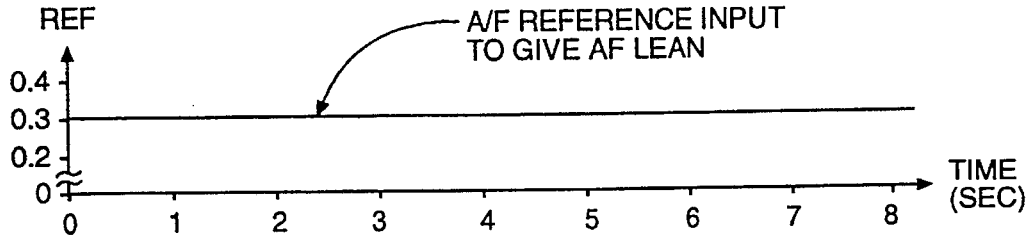
Figure 3E:
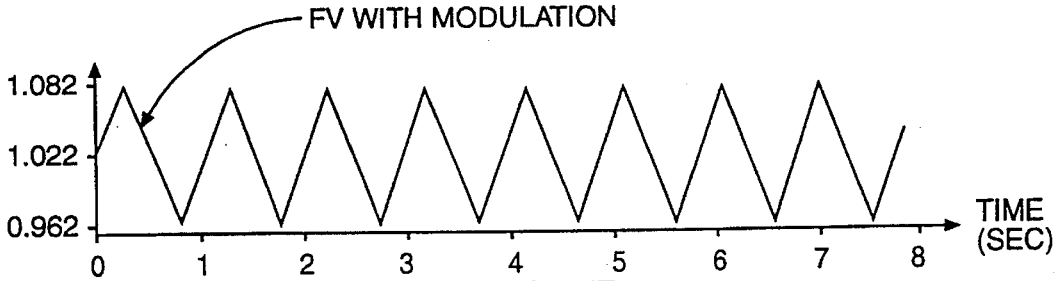

Referring now to FIGS. 3A–3E, and FIG. 4, graphical representations are shown which correspond to process steps 122–156 which were previously described with particular reference to FIGS. 2A–2E. In this particular example which depicts steady state lean air/fuel operation, reference signal REF is set to lean value REFLEAN (see FIG. 3D) to provide an average air/fuel ratio lean of stoichiometry while feedback variable FV is being modulated with a triangular wave (FIG. 3E). Such modulation occurs until an indication is provided that catalytic converter 52 has reached a desired temperature.

In this particular example, the effect of such modulation and selection of lean reference value REFLEAN provides the exhaust air/fuel ratio shown in FIG. 3A. The average value of this air/fuel ratio is shown as the dashed line labeled AFLEAN which is lean of the stoichiometric air/fuel ratio labeled AFSTOIC. Corresponding signal EGO from sensor 44 is shown in FIG. 3B wherein a high voltage state is indicative of air/fuel operation rich of stoichiometry and a low voltage state is indicative of air/fuel operation lean of stoichiometry. The rolling average of signal EGO, which is the air/fuel indicating signal, is shown in FIG. 3C. In this example showing steady state operation, the rolling average of signal EGO (FIG. 3C) is forced to the same value as lean reference value REFLEAN (FIG. 3D).

Figure 4:
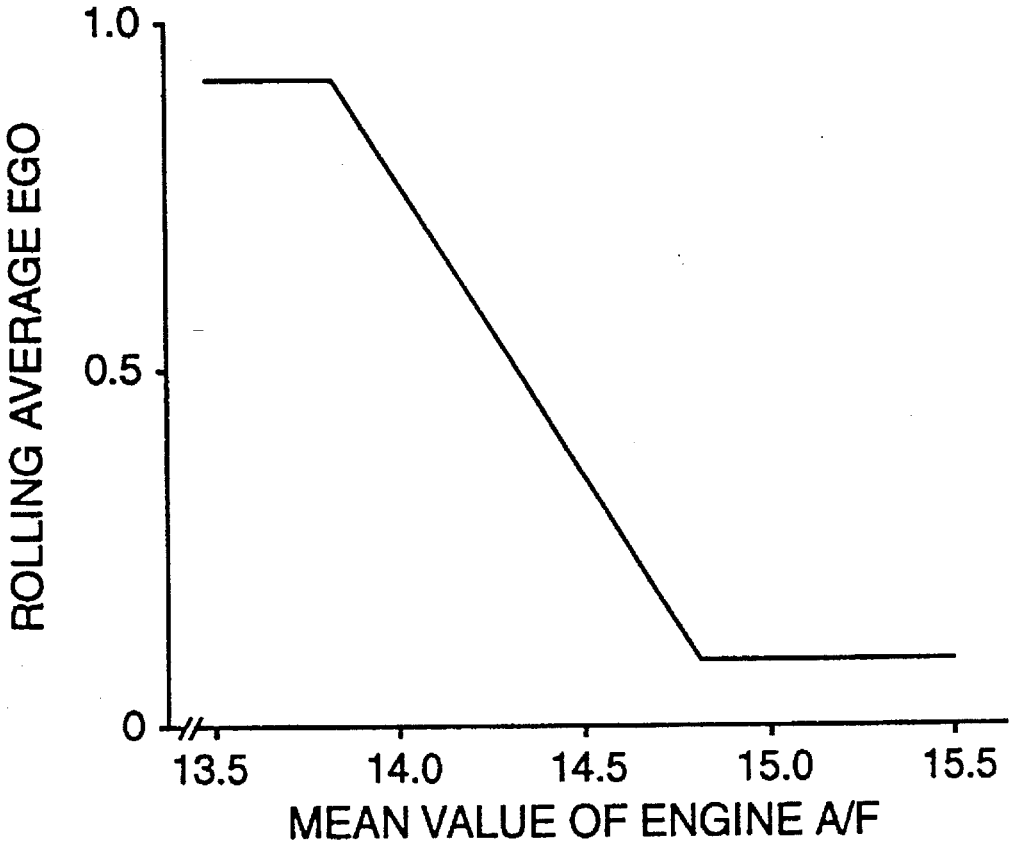
FIG. 4 is a graphical representation showing how the rolling average of signal EGO provides an average air/fuel indicating signal.

Referring to FIG. 4, a hypothetical graphical representation of the rolling average of signal EGO, which is the lean air/fuel indicating signal, in relation to the average engine air/fuel ratio is shown. It is seen that an advantage of the invention claimed herein is that a linear air/fuel indicating signal is provided from a two-state exhaust gas oxygen sensor. In this particular example, the air/fuel indicating signal is used to operate engine 28 at an average value lean of stoichiometry using accurate feedback control.

The adaptive learning subroutine for learning correction value K during both cold engine and hot engine operation is now described with reference to the flowchart shown in FIG. 5. Operation for entering closed loop air/fuel control is first determined in step 300 as soon as EGO Sensor 44 reaches its operating temperature and engine coolant temperature ECT is not less than T1 in step 106 in FIGS. 2A–2B. Engine speed and load are then read during step 304 and the correction values generated below stored in tables for each speed load range.

When engine coolant temperature ECT is less than temperature T4 (step 306) and also less than T3, the cold K tables are updated as now described. If feedback variable FV is greater than its nominal value (unity in this example) plus the lean offset introduced as previously described with reference to FIGS. 2A–2B (step 310), then the cold K table speed/load cell is decremented by ΔK (step 312). On the other hand, if feedback variable FV is less than unity plus the lean offset (step 310), the corresponding speed/load cell in the cold K table incremented by ΔK (step 314).

Operation proceeds in a similar manner to adaptively learn correction value K during hot engine operation when engine coolant temperature ECT is greater than temperature T4 (step 306). More specifically, when feedback variable FV is greater than unity (step 320), the speed/load cell of the hot K table is decremented by ΔK (step 322). Similarly, when feedback variable FV is less than unity (step 320), the speed/load cell of the hot K table is incremented by ΔK (step 324).

The subroutine described above with respect to FIG. 4 provides an adaptive learning of the difference or error between actual engine air/fuel operation and the desired air/fuel ratio. It is also operable when the desired air/fuel ratio is offset from stoichiometry by a preselected offset.

Although one example of an embodiment which practices the invention has been described herein, there are numerous other examples which could also be described. For example, analog devices, or discreet IC's may be used to advantage rather than a microcomputer. Further, different feedback controllers other than proportional plus integral may be used to advantage. The invention is therefore to be defined only in accordance with the following claims.

What is claimed:

1. A control method for an engine having an exhaust gas oxygen sensor with a two state output having first and second states respectively corresponding to exhaust gases being rich or lean of stoichiometry, comprising the steps of:

delivering fuel to the engine;

modulating said delivered fuel;

averaging the exhaust gas oxygen sensor output to provide an air/fuel indicating signal having an amplitude related to engine air/fuel operation;

selecting both a desired air/fuel ratio and a reference value corresponding to said desired air/fuel ratio;

generating an error signal from a difference between said averaged sensor output and said reference value;

generating a feedback variable from said error signal;

correcting said delivered fuel with said feedback variable so that engine air/fuel operation averages at said desired air/fuel ratio.

2. The method recited in claim 1 wherein said step of averaging comprises a rolling average of the sensor output.

3. A control method for an engine having an exhaust gas oxygen sensor with a two state output having first and second states respectively corresponding to exhaust gases being rich or lean of stoichiometry, comprising the steps of:

delivering fuel to the engine;

modulating said delivered fuel;

averaging the exhaust gas oxygen sensor output to provide an air/fuel indicating signal having an amplitude related to engine air/fuel operation;

providing a reference signal having a first reference value corresponding to a desired air/fuel ratio lean of stoichiometry and a second reference value corresponding to a stoichiometric air/fuel ratio;

generating an error signal from a difference between said air/fuel indicating signal and said reference signal;

generate a feedback variable; from said error signal and correcting said delivered fuel with said feedback variable so that engine air/fuel operation averages at said desired air/fuel ratio.

4. The control method recited in claim 3 wherein said reference signal is provided with said first reference value during cold engine operation.

5. The control method recited in claim 4 further comprising a step of retarding engine ignition timing from a nominal value during said cold engine operation to increase exhaust gas temperature during said cold engine operation.

6. A control system for an engine, comprising:

an exhaust gas oxygen sensor with a two state output having first and second states respectively corresponding to exhaust gases being rich or lean of stoichiometry;

a fuel controller delivering fuel to the engine in response to a desired fuel signal;

a controller modulating said desired fuel signal and averaging an output of the exhaust gas oxygen sensor to provide an air/fuel indicating signal having an amplitude related to engine air/fuel operation;

reference means for providing a reference signal having a first reference value corresponding to an air/fuel ratio lean of stoichiometry during cold engine operation and a second reference value corresponding to a stoichiometric air/fuel ratio during warm engine operation; and feedback means for integrating an error signal derived from a difference between said air/fuel indicating signal and said reference signal to generate a feedback variable, and correcting said delivered fuel with said feedback variable so that engine air/fuel operation averages at said desired air/fuel ratio.

7. The control system recited in claim 6 further comprising an ignition controller for providing engine ignition timing retarded from a nominal value during said cold engine operation to increase exhaust gas temperature during said cold engine operation to increase exhaust gas temperature during said cold engine operation.

8. The control system recited in claim 6 wherein said controller provides a modulating signal for modulating said desired fuel signal.

9. The control system recited in claim 8 wherein said controller provides said modulating signal with an amplitude related to engine temperature.

* * * * *